US012225927B2

(12) United States Patent
Sutton et al.

(10) Patent No.: US 12,225,927 B2
(45) Date of Patent: Feb. 18, 2025

(54) CARTRIDGE, POUCH AND METHOD OF MANUFACTURE OF POUCH FOR USE WITH APPARATUS FOR HEATING SMOKABLE MATERIAL

(71) Applicants: Joseph Sutton, London (GB); Dominic Woodcock, London (GB); Darren Seymour, London (GB); Hitesh Vallabh, London (GB); Neil Litten, London (GB); Harpal Singh, London (GB); Ahmad Bitar, London (GB); David Russell, London (GB)

(72) Inventors: Joseph Sutton, London (GB); Dominic Woodcock, London (GB); Darren Seymour, London (GB); Hitesh Vallabh, London (GB); Neil Litten, London (GB); Harpal Singh, London (GB); Ahmad Bitar, London (GB); David Russell, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

(21) Appl. No.: 18/339,287

(22) Filed: Jun. 22, 2023

(65) Prior Publication Data

US 2023/0337720 A1 Oct. 26, 2023

Related U.S. Application Data

(63) Continuation of application No. 15/563,078, filed as application No. PCT/EP2016/057060 on Mar. 31, 2016, now Pat. No. 11,723,396.

(30) Foreign Application Priority Data

Mar. 31, 2015 (GB) ..... 1505595

(51) Int. Cl.
*A24F 40/20* (2020.01)
*A24C 5/01* (2020.01)
(Continued)

(52) U.S. Cl.
CPC ..... *A24C 5/01* (2020.01); *A24D 1/20* (2020.01); *A24F 40/30* (2020.01); *A24F 40/40* (2020.01); *A24F 40/42* (2020.01); *A24F 40/20* (2020.01)

(58) Field of Classification Search
None
See application file for complete search history.

(56) References Cited

U.S. PATENT DOCUMENTS 2,057,353 A 10/1936 Whittemore
2,809,634 A 10/1957 Hirotada
(Continued)

FOREIGN PATENT DOCUMENTS

AT 508244 A4 12/2010
AU 6393173 A 6/1975
(Continued)

OTHER PUBLICATIONS

Aerosols, "Pulmonary Pharmacoloy: Delivery Devices and Medications", available at www.cdeu.org/cecourses/z98207/ch4.htm, Sep. 6, 2017, 2 Pages.
(Continued)

*Primary Examiner* — Katherine A Will
(74) *Attorney, Agent, or Firm* — Husch Blackwell

(57) ABSTRACT

A cartridge is provided for use with an apparatus for heating smokable material. The cartridge has a housing defining a chamber and a pouch containing smokable material. The pouch is located within the chamber. At least part of the pouch is made of porous material for permitting aerosol or volatilized material generated within the pouch to pass out
(Continued)

of the pouch from within the pouch. There is also provided a pouch having a first wall and a second wall. The pouch contains smokable material between the first wall and the second wall. A method of manufacturing a pouch is also disclosed in which the first wall is attached to the second wall with smokable material between the first wall and second wall.

24 Claims, 4 Drawing Sheets

(51) Int. Cl.

| | |
|---|---|
| ***A24D 1/20*** | (2020.01) |
| ***A24F 40/30*** | (2020.01) |
| ***A24F 40/40*** | (2020.01) |
| ***A24F 40/42*** | (2020.01) |

(56) References Cited

U.S. PATENT DOCUMENTS

| | | | |
|---|---|---|---|
| 2,937,648 | A | 5/1960 | Meyer |
| 2,991,788 | A | 7/1961 | Brost |
| 3,111,396 | A | 11/1963 | Ball |
| 3,148,996 | A | 9/1964 | Vukasovich et al. |
| 3,239,117 | A | 3/1966 | Letchworth |
| 3,402,724 | A | 9/1968 | Blount et al. |
| 3,431,393 | A | 3/1969 | Katsuda |
| 3,433,632 | A | 3/1969 | Elbert et al. |
| 3,521,643 | A | 7/1970 | Toth |
| 3,604,428 | A | 9/1971 | Moukaddem |
| 3,804,100 | A | 4/1974 | Fariello |
| 3,844,199 | A | 10/1974 | Block et al. |
| 3,964,902 | A | 6/1976 | Fletcher et al. |
| 4,009,713 | A | 3/1977 | Simmons et al. |
| 4,031,906 | A | 6/1977 | Knapp |
| 4,094,119 | A | 6/1978 | Sullivan |
| 4,145,001 | A | 3/1979 | Weyenberg et al. |
| 4,161,283 | A | 7/1979 | Hyman |
| 4,193,513 | A | 3/1980 | Bull |
| 4,219,031 | A | 8/1980 | Full et al. |
| 4,503,851 | A | 3/1985 | Braunroth |
| 4,588,976 | A | 5/1986 | Jaselli |
| 4,676,237 | A | 6/1987 | Wood et al. |
| 4,735,217 | A | 4/1988 | Gerth et al. |
| 4,827,950 | A | 5/1989 | Banerjee et al. |
| 4,830,028 | A | 5/1989 | Lawson et al. |
| 4,846,199 | A | 7/1989 | Rose |
| 4,848,374 | A | 7/1989 | Chard et al. |
| 4,885,129 | A | 12/1989 | Leonard et al. |
| 4,917,301 | A | 4/1990 | Munteanu |
| 4,922,901 | A | 5/1990 | Brooks et al. |
| 4,924,886 | A | 5/1990 | Litzinger |
| 4,947,874 | A | 8/1990 | Brooks et al. |
| 4,947,875 | A | 8/1990 | Brooks et al. |
| 4,978,814 | A | 12/1990 | Honour |
| 5,027,837 | A | 7/1991 | Clearman et al. |
| 5,046,514 | A | 9/1991 | Bolt |
| 5,060,671 | A | 10/1991 | Counts et al. |
| 5,065,776 | A | 11/1991 | Lawson et al. |
| 5,095,647 | A | 3/1992 | Zobele et al. |
| 5,095,921 | A | 3/1992 | Losee et al. |
| 5,099,861 | A | 3/1992 | Clearman et al. |
| 5,115,823 | A | 5/1992 | Keritsis |
| 5,121,881 | A | 6/1992 | Lembeck |
| 5,129,409 | A | 7/1992 | White et al. |
| 5,144,962 | A | 9/1992 | Counts et al. |
| 5,167,242 | A | 12/1992 | Turner et al. |
| 5,179,966 | A | 1/1993 | Losee et al. |
| 5,247,947 | A | 9/1993 | Clearman et al. |
| 5,322,075 | A | 6/1994 | Deevi et al. |
| 5,369,723 | A | 11/1994 | Counts et al. |
| 5,388,574 | A | 2/1995 | Ingebrethsen |
| 5,390,864 | A | 2/1995 | Alexander |
| 5,415,186 | A | 5/1995 | Casey et al. |
| 5,415,486 | A | 5/1995 | Wouters et al. |
| 5,479,948 | A | 1/1996 | Counts et al. |
| 5,497,792 | A | 3/1996 | Prasad et al. |
| 5,501,236 | A | 3/1996 | Hill et al. |
| 5,505,214 | A | 4/1996 | Collins et al. |
| 5,540,241 | A | 7/1996 | Kim |
| 5,553,791 | A | 9/1996 | Alexander |
| 5,611,360 | A | 3/1997 | Tang |
| 5,636,787 | A | 6/1997 | Gowhari |
| 5,649,554 | A | 7/1997 | Sprinkel et al. |
| 5,666,977 | A | 9/1997 | Higgins et al. |
| 5,692,291 | A | 12/1997 | Deevi et al. |
| 5,692,526 | A | 12/1997 | Adams et al. |
| 5,743,251 | A | 4/1998 | Howell et al. |
| 5,865,185 | A | 2/1999 | Collins et al. |
| 5,954,060 | A | 9/1999 | Cardarelli |
| 6,095,505 | A | 8/2000 | Miller |
| 6,155,268 | A | 12/2000 | Takeuchi |
| 6,275,650 | B1 | 8/2001 | Lambert |
| 6,280,793 | B1 | 8/2001 | Atwell et al. |
| 6,532,965 | B1 | 3/2003 | Abhulimen et al. |
| 6,652,804 | B1 | 11/2003 | Neumann et al. |
| 6,681,998 | B2 | 1/2004 | Sharpe et al. |
| 6,701,921 | B2 | 3/2004 | Sprinkel et al. |
| 6,790,496 | B1 | 9/2004 | Levander et al. |
| 7,100,618 | B2 | 9/2006 | Dominguez |
| 7,112,712 | B1 | 9/2006 | Ancell |
| 7,263,228 | B2 | 8/2007 | Mori |
| 7,400,940 | B2 | 7/2008 | McRae et al. |
| 7,540,286 | B2 | 6/2009 | Cross et al. |
| 7,767,698 | B2 | 8/2010 | Warchol et al. |
| 7,832,410 | B2 | 11/2010 | Hon |
| 7,992,554 | B2 | 8/2011 | Radomski et al. |
| 8,156,944 | B2 | 4/2012 | Han |
| 8,205,622 | B2 | 6/2012 | Pan |
| 8,365,742 | B2 | 2/2013 | Hon |
| 8,375,957 | B2 | 2/2013 | Hon |
| 8,393,331 | B2 | 3/2013 | Hon |
| 8,430,106 | B2 | 4/2013 | Potter et al. |
| 8,490,628 | B2 | 7/2013 | Hon |
| 8,511,318 | B2 | 8/2013 | Hon |
| 8,689,805 | B2 | 4/2014 | Hon |
| 8,752,545 | B2 | 6/2014 | Buchberger |
| 8,833,364 | B2 | 9/2014 | Buchberger |
| 8,948,578 | B2 | 2/2015 | Buchberger |
| 8,975,764 | B1 | 3/2015 | Abehasera |
| 9,623,205 | B2 | 4/2017 | Buchberger |
| 9,943,108 | B2 | 4/2018 | Lord |
| 9,974,335 | B2 | 5/2018 | Lord |
| 10,111,466 | B2 | 10/2018 | Lord |
| 10,278,421 | B2 | 5/2019 | Lord |
| 10,582,729 | B2 | 3/2020 | Lord |
| 10,588,354 | B2 | 3/2020 | Lord |
| 2001/0042546 | A1 | 11/2001 | Umeda et al. |
| 2002/0016370 | A1 | 2/2002 | Shytle et al. |
| 2002/0079309 | A1 | 6/2002 | Cox et al. |
| 2003/0005620 | A1 | 1/2003 | Ananth et al. |
| 2003/0049025 | A1 | 3/2003 | Neumann et al. |
| 2003/0063902 | A1 | 4/2003 | Pedrotti et al. |
| 2003/0079309 | A1 | 5/2003 | Vandenbelt et al. |
| 2003/0106552 | A1 | 6/2003 | Sprinkel et al. |
| 2003/0200964 | A1 | 10/2003 | Blakley et al. |
| 2004/0031485 | A1 | 2/2004 | Rustad et al. |
| 2004/0065749 | A1 | 4/2004 | Kotary et al. |
| 2004/0129793 | A1 | 7/2004 | Nguyen et al. |
| 2005/0204799 | A1 | 9/2005 | Koch |
| 2005/0268911 | A1 | 12/2005 | Cross et al. |
| 2006/0078477 | A1 | 4/2006 | Althouse et al. |
| 2006/0131439 | A1 | 6/2006 | Lakatos et al. |
| 2007/0014549 | A1 | 1/2007 | Demarest et al. |
| 2007/0062548 | A1 | 3/2007 | Horstmann et al. |
| 2007/0102013 | A1 | 5/2007 | Adams et al. |
| 2007/0107879 | A1 | 5/2007 | Radomski et al. |
| 2007/0137667 | A1 | 6/2007 | Zhuang et al. |
| 2007/0155255 | A1 | 7/2007 | Galauner et al. |
| 2007/0283972 | A1 | 12/2007 | Monsees et al. |
| 2008/0092912 | A1 | 4/2008 | Robinson et al. |
| 2008/0216828 | A1 | 9/2008 | Wensley et al. |

(56) References Cited

U.S. PATENT DOCUMENTS

| | | | |
|---|---|---|---|
| 2008/0241255 | A1 | 10/2008 | Rose et al. |
| 2009/0095311 | A1 | 4/2009 | Han |
| 2009/0188490 | A1 | 7/2009 | Han |
| 2009/0272379 | A1 | 11/2009 | Thorens et al. |
| 2009/0288668 | A1 | 11/2009 | Inagaki |
| 2009/0293888 | A1 | 12/2009 | Williams et al. |
| 2009/0293892 | A1 | 12/2009 | Williams et al. |
| 2009/0302019 | A1 | 12/2009 | Selenski et al. |
| 2010/0006113 | A1 | 1/2010 | Urtsev et al. |
| 2010/0024834 | A1 | 2/2010 | Oglesby et al. |
| 2010/0059070 | A1 | 3/2010 | Potter et al. |
| 2010/0065653 | A1 | 3/2010 | Wingo et al. |
| 2010/0083959 | A1 | 4/2010 | Siller |
| 2010/0108059 | A1 | 5/2010 | Axelsson et al. |
| 2010/0236546 | A1 | 9/2010 | Yamada et al. |
| 2011/0005535 | A1 | 1/2011 | Xiu |
| 2011/0011396 | A1 | 1/2011 | Fang |
| 2011/0036363 | A1 | 2/2011 | Urtsev et al. |
| 2011/0094523 | A1 | 4/2011 | Thorens et al. |
| 2011/0126848 | A1 | 6/2011 | Zuber et al. |
| 2011/0155153 | A1 | 6/2011 | Thorens et al. |
| 2011/0168194 | A1 | 7/2011 | Hon |
| 2011/0209717 | A1 | 9/2011 | Han |
| 2011/0226236 | A1 | 9/2011 | Buchberger |
| 2011/0232654 | A1 | 9/2011 | Mass |
| 2011/0277756 | A1 | 11/2011 | Terry et al. |
| 2011/0277757 | A1 | 11/2011 | Terry et al. |
| 2011/0290267 | A1 | 12/2011 | Yamada et al. |
| 2011/0297166 | A1 | 12/2011 | Takeuchi et al. |
| 2011/0303231 | A1 | 12/2011 | Li et al. |
| 2012/0006343 | A1 | 1/2012 | Renaud et al. |
| 2012/0111347 | A1 | 5/2012 | Hon |
| 2012/0145169 | A1 | 6/2012 | Wu |
| 2012/0179512 | A1 | 7/2012 | Okeeffe |
| 2012/0227753 | A1 | 9/2012 | Newton |
| 2012/0234821 | A1 | 9/2012 | Shimizu |
| 2012/0255567 | A1 | 10/2012 | Rose et al. |
| 2012/0260927 | A1 | 10/2012 | Liu |
| 2012/0279512 | A1 | 11/2012 | Hon |
| 2012/0285475 | A1 | 11/2012 | Liu |
| 2012/0285476 | A1 | 11/2012 | Hon |
| 2013/0037041 | A1 | 2/2013 | Worm et al. |
| 2013/0056013 | A1 | 3/2013 | Terry et al. |
| 2013/0074857 | A1 | 3/2013 | Buchberger |
| 2013/0081619 | A1 | 4/2013 | Seakins et al. |
| 2013/0081623 | A1 | 4/2013 | Buchberger |
| 2013/0192615 | A1 | 8/2013 | Tucker et al. |
| 2013/0192623 | A1 | 8/2013 | Tucker et al. |
| 2013/0213417 | A1 | 8/2013 | Chong et al. |
| 2013/0213419 | A1 | 8/2013 | Tucker et al. |
| 2013/0284192 | A1 | 10/2013 | Peleg et al. |
| 2013/0298905 | A1 | 11/2013 | Levin et al. |
| 2013/0306085 | A1 | 11/2013 | Sanchez et al. |
| 2013/0333700 | A1 | 12/2013 | Buchberger |
| 2013/0340779 | A1 | 12/2013 | Liu |
| 2014/0000638 | A1 | 1/2014 | Sebastian et al. |
| 2014/0007863 | A1 | 1/2014 | Chen |
| 2014/0024834 | A1 | 1/2014 | Mergelsberg et al. |
| 2014/0060528 | A1 | 3/2014 | Liu |
| 2014/0060529 | A1 | 3/2014 | Zhang |
| 2014/0060554 | A1 | 3/2014 | Collett et al. |
| 2014/0060555 | A1 | 3/2014 | Chang et al. |
| 2014/0069444 | A1 | 3/2014 | Cyphert et al. |
| 2014/0202454 | A1 | 7/2014 | Buchberger |
| 2014/0209105 | A1 | 7/2014 | Sears et al. |
| 2014/0238396 | A1 | 8/2014 | Buchberger |
| 2014/0238423 | A1 | 8/2014 | Tucker et al. |
| 2014/0238424 | A1 | 8/2014 | Macko et al. |
| 2014/0261490 | A1 | 9/2014 | Kane |
| 2014/0270730 | A1 | 9/2014 | Depiano et al. |
| 2014/0283825 | A1 | 9/2014 | Buchberger |
| 2014/0286630 | A1 | 9/2014 | Buchberger |
| 2014/0299125 | A1 | 10/2014 | Buchberger |
| 2014/0299142 | A1 | 10/2014 | Dincer et al. |
| 2014/0338680 | A1 | 11/2014 | Abramov et al. |
| 2015/0020831 | A1 | 1/2015 | Weigensberg et al. |
| 2015/0114411 | A1 | 4/2015 | Buchberger |
| 2015/0150302 | A1 | 6/2015 | Metrangolo et al. |
| 2015/0157055 | A1 | 6/2015 | Lord |
| 2015/0196058 | A1 | 7/2015 | Lord |
| 2015/0201675 | A1 | 7/2015 | Lord |
| 2015/0208728 | A1 | 7/2015 | Lord |
| 2015/0245654 | A1 | 9/2015 | Memari et al. |
| 2015/0258288 | A1 | 9/2015 | Sullivan |
| 2015/0333552 | A1 | 11/2015 | Alarcon |
| 2015/0333561 | A1 | 11/2015 | Alarcon |
| 2016/0073693 | A1 | 3/2016 | Reevell |
| 2016/0106154 | A1 | 4/2016 | Lord |
| 2016/0106155 | A1 | 4/2016 | Reevell |
| 2016/0250201 | A1 | 9/2016 | Rose et al. |
| 2016/0278436 | A1 | 9/2016 | Verleur et al. |
| 2016/0295923 | A1 | 10/2016 | Lin |
| 2016/0353804 | A1 | 12/2016 | Lord |
| 2017/0042245 | A1 | 2/2017 | Buchberger et al. |
| 2017/0114965 | A1 | 4/2017 | Maglica et al. |
| 2017/0143042 | A1 | 5/2017 | Batista et al. |
| 2017/0173278 | A1 | 6/2017 | Buchberger |
| 2017/0197043 | A1 | 7/2017 | Buchberger |
| 2017/0197044 | A1 | 7/2017 | Buchberger |
| 2017/0197046 | A1 | 7/2017 | Buchberger |
| 2017/0208865 | A1 | 7/2017 | Nettenstrom et al. |
| 2017/0251725 | A1 | 9/2017 | Buchberger et al. |
| 2017/0360088 | A1* | 12/2017 | Pijnenburg ..... A24F 40/53 |
| 2018/0192705 | A1 | 7/2018 | Lord |
| 2018/0199618 | A1 | 7/2018 | Fuisz et al. |
| 2018/0235284 | A1 | 8/2018 | Lord |
| 2021/0100285 | A1 | 4/2021 | Spencer et al. |

FOREIGN PATENT DOCUMENTS

| | | | |
|---|---|---|---|
| CA | 2309376 | A1 | 11/2000 |
| CA | 2864238 | A1 | 8/2013 |
| CH | 698603 | B1 | 9/2009 |
| CN | 1040496 | A | 3/1990 |
| CN | 2082939 | U | 8/1991 |
| CN | 2092880 | U | 1/1992 |
| CN | 2220168 | Y | 2/1996 |
| CN | 2249068 | Y | 3/1997 |
| CN | 1205849 | A | 1/1999 |
| CN | 2719043 | Y | 8/2005 |
| CN | 1925757 | A | 3/2007 |
| CN | 201054977 | Y | 5/2008 |
| CN | 201079011 | Y | 7/2008 |
| CN | 101277623 | A | 10/2008 |
| CN | 201238609 | Y | 5/2009 |
| CN | 101500443 | A | 8/2009 |
| CN | 201375023 | Y | 1/2010 |
| CN | 201379072 | Y | 1/2010 |
| CN | 201468000 | U | 5/2010 |
| CN | 101795505 | A | 8/2010 |
| CN | 101843368 | A | 9/2010 |
| CN | 101878958 | A | 11/2010 |
| CN | 202085723 | U | 12/2011 |
| CN | 202172846 | U | 3/2012 |
| CN | 102655773 | A | 9/2012 |
| CN | 202722498 | U | 2/2013 |
| CN | 202750708 | U | 2/2013 |
| CN | 103070472 | A | 5/2013 |
| CN | 203168033 | U | 9/2013 |
| CN | 103750573 | A | 4/2014 |
| CN | 103929988 | A | 7/2014 |
| CN | 103974369 | A | 8/2014 |
| CN | 103974639 | A | 8/2014 |
| CN | 104095293 | A | 10/2014 |
| CN | 203943069 | U | 11/2014 |
| CN | 204120237 | U | 1/2015 |
| CN | 104349687 | A | 2/2015 |
| CN | 106102863 | A | 11/2016 |
| DE | 822964 | C | 11/1951 |
| DE | 1950439 | A1 | 4/1971 |
| DE | 3148335 | A1 | 7/1983 |
| DE | 3218760 | A1 | 12/1983 |
| DE | 3844022 | C1 | 2/1990 |
| DE | 3936687 | A1 | 5/1990 |

(56) References Cited

FOREIGN PATENT DOCUMENTS

| | | | |
|---|---|---|---|
| DE | 29713866 | U1 | 10/1997 |
| DE | 19630619 | A1 | 2/1998 |
| DE | 19654945 | A1 | 3/1998 |
| DE | 10330681 | B3 | 6/2004 |
| DE | 202006013439 | U1 | 10/2006 |
| DE | 102006004484 | A1 | 8/2007 |
| DE | 102007011120 | A1 | 9/2008 |
| DE | 202013100606 | U1 | 2/2013 |
| EA | 015651 | B1 | 10/2011 |
| EA | 201100197 | A1 | 3/2012 |
| EP | 0280262 | A2 | 8/1988 |
| EP | 0295122 | A2 | 12/1988 |
| EP | 0358002 | A2 | 3/1990 |
| EP | 0444553 | A2 | 9/1991 |
| EP | 0488488 | A1 | 6/1992 |
| EP | 0532194 | A1 | 3/1993 |
| EP | 0712584 | A2 | 5/1996 |
| EP | 0845220 | A1 | 6/1998 |
| EP | 0893071 | A1 | 1/1999 |
| EP | 1166814 | A2 | 1/2002 |
| EP | 1166847 | A2 | 1/2002 |
| EP | 1283062 | A1 | 2/2003 |
| EP | 0845220 | B1 | 9/2003 |
| EP | 1486226 | A2 | 12/2004 |
| EP | 1736065 | A1 | 12/2006 |
| EP | 2018886 | A1 | 1/2009 |
| EP | 2022349 | A1 | 2/2009 |
| EP | 1736065 | B1 | 6/2009 |
| EP | 2113178 | A1 | 11/2009 |
| EP | 2119375 | A1 | 11/2009 |
| EP | 2327318 | A1 | 6/2011 |
| EP | 2340729 | A1 | 7/2011 |
| EP | 2394520 | A1 | 12/2011 |
| EP | 2404515 | A1 | 1/2012 |
| EP | 2444112 | A1 | 4/2012 |
| EP | 2444411 | A1 | 4/2012 |
| EP | 2695531 | A1 | 2/2014 |
| EP | 2698070 | A1 | 2/2014 |
| EP | 2762019 | A1 | 8/2014 |
| EP | 2835062 | A1 | 2/2015 |
| EP | 2939553 | A1 | 11/2015 |
| EP | 2083643 | B1 | 9/2017 |
| FR | 960469 | A | 4/1950 |
| GB | 25575 | | 3/1912 |
| GB | 1313525 | A | 4/1973 |
| GB | 2333466 | A | 7/1999 |
| GB | 2488257 | A | 8/2012 |
| GB | 2496105 | A | 5/2013 |
| HK | 1196511 | A1 | 12/2014 |
| HK | 1226611 | | 10/2017 |
| JP | S5130900 | U | 3/1976 |
| JP | S5752456 | A | 3/1982 |
| JP | S59106340 | A | 6/1984 |
| JP | S6196763 | A | 5/1986 |
| JP | S6196765 | A | 5/1986 |
| JP | H02124081 | A | 5/1990 |
| JP | H0339077 | A | 2/1991 |
| JP | H05103836 | A | 4/1993 |
| JP | H05309136 | A | 11/1993 |
| JP | H06315366 | A | 11/1994 |
| JP | H07502188 | A | 3/1995 |
| JP | H0878142 | A | 3/1996 |
| JP | H08299862 | A | 11/1996 |
| JP | H1189551 | A | 4/1999 |
| JP | H11507234 | A | 6/1999 |
| JP | 2002527153 | A | 8/2002 |
| JP | 3392138 | B2 | 3/2003 |
| JP | 2004332069 | A | 11/2004 |
| JP | 2005537918 | A | 12/2005 |
| JP | 2006504431 | A | 2/2006 |
| JP | 2007259864 | A | 10/2007 |
| JP | 2007267749 | A | 10/2007 |
| JP | 2009502136 | A | 1/2009 |
| JP | 2009504431 | A | 2/2009 |
| JP | 3153675 | U | 9/2009 |
| JP | 2009537119 | A | 10/2009 |
| JP | 2010520742 | A | 6/2010 |
| JP | 3164992 | U | 12/2010 |
| JP | 2011518567 | A | 6/2011 |
| JP | 2012517229 | A | 8/2012 |
| JP | 5130900 | B2 | 1/2013 |
| JP | 2013545473 | A | 12/2013 |
| JP | 2014076065 | A | 5/2014 |
| JP | 2014525237 | A | 9/2014 |
| JP | 2015506170 | A | 3/2015 |
| JP | 2015524257 | A | 8/2015 |
| KR | 20110006928 | A | 1/2011 |
| KR | 20110006928 | U | 7/2011 |
| KR | 101081481 | B1 | 11/2011 |
| RU | 2004116065 | A | 6/2005 |
| RU | 2311859 | C2 | 12/2007 |
| RU | 2336001 | C2 | 10/2008 |
| RU | 89927 | U1 | 12/2009 |
| RU | 94815 | U1 | 6/2010 |
| RU | 103281 | U1 | 4/2011 |
| RU | 2420290 | C2 | 6/2011 |
| RU | 110608 | U1 | 11/2011 |
| RU | 115629 | U1 | 5/2012 |
| RU | 122000 | U1 | 11/2012 |
| RU | 124120 | U1 | 1/2013 |
| RU | 2480485 | C2 | 4/2013 |
| RU | 145715 | U1 | 9/2014 |
| RU | 158129 | U1 | 12/2015 |
| SU | 1641182 | A3 | 4/1991 |
| TW | 201225862 | A | 7/2012 |
| WO | 9406313 | A1 | 3/1994 |
| WO | 9502712 | A2 | 1/1995 |
| WO | 9527412 | A1 | 10/1995 |
| WO | 9632854 | A2 | 10/1996 |
| WO | 9639880 | A1 | 12/1996 |
| WO | 9748293 | A1 | 12/1997 |
| WO | 9836651 | A1 | 8/1998 |
| WO | 0009188 | A1 | 2/2000 |
| WO | 0021598 | A1 | 4/2000 |
| WO | 02058747 | A1 | 8/2002 |
| WO | 03028409 | A1 | 4/2003 |
| WO | 03050405 | A1 | 6/2003 |
| WO | 03083283 | A1 | 10/2003 |
| WO | 03101454 | A1 | 12/2003 |
| WO | 2004022128 | A2 | 3/2004 |
| WO | 2004022242 | A1 | 3/2004 |
| WO | 2004022243 | A1 | 3/2004 |
| WO | 2004080216 | A1 | 9/2004 |
| WO | 2005106350 | A2 | 11/2005 |
| WO | 2006048774 | A1 | 5/2006 |
| WO | 2006082571 | A1 | 8/2006 |
| WO | 2007012007 | A2 | 1/2007 |
| WO | 2007042941 | A2 | 4/2007 |
| WO | 2007078273 | A1 | 7/2007 |
| WO | 2007131449 | A1 | 11/2007 |
| WO | 2008015441 | A1 | 2/2008 |
| WO | 2008029381 | A2 | 3/2008 |
| WO | 2009015410 | A1 | 2/2009 |
| WO | 2009022232 | A2 | 2/2009 |
| WO | 2009132793 | A1 | 11/2009 |
| WO | 2010045670 | A1 | 4/2010 |
| WO | 2010045671 | A1 | 4/2010 |
| WO | 2010091593 | A1 | 8/2010 |
| WO | 2011060788 | A1 | 5/2011 |
| WO | 2011079932 | A1 | 7/2011 |
| WO | 2011106788 | A2 | 9/2011 |
| WO | 2011107737 | A1 | 9/2011 |
| WO | 2011109849 | A1 | 9/2011 |
| WO | 2011124033 | A1 | 10/2011 |
| WO | 2011137453 | A2 | 11/2011 |
| WO | 2011146372 | A2 | 11/2011 |
| WO | 2011160788 | A1 | 12/2011 |
| WO | 2012025496 | A1 | 3/2012 |
| WO | 2012072762 | A1 | 6/2012 |
| WO | 2012156700 | A1 | 11/2012 |
| WO | 2013034453 | A1 | 3/2013 |
| WO | 2013034460 | A1 | 3/2013 |
| WO | 2013057185 | A1 | 4/2013 |
| WO | 2013060784 | A2 | 5/2013 |

(56) References Cited

FOREIGN PATENT DOCUMENTS

| | | | |
|---|---|---|---|
| WO | 2013076098 | A2 | 5/2013 |
| WO | 2013082173 | A1 | 6/2013 |
| WO | 2013083631 | A1 | 6/2013 |
| WO | 2013083634 | A1 | 6/2013 |
| WO | 2013098395 | A1 | 7/2013 |
| WO | 2013116558 | A1 | 8/2013 |
| WO | 2013116571 | A1 | 8/2013 |
| WO | 2013148810 | A1 | 10/2013 |
| WO | 2013149404 | A1 | 10/2013 |
| WO | 2013178766 | A1 | 12/2013 |
| WO | 2014061477 | A1 | 4/2014 |
| WO | 2014104078 | A1 | 7/2014 |
| WO | 2014106093 | A1 | 7/2014 |
| WO | 2014130695 | A1 | 8/2014 |
| WO | 2014136872 | A1 | 9/2014 |
| WO | 2014140320 | A1 | 9/2014 |
| WO | 2014150131 | A1 | 9/2014 |
| WO | 2015117702 | A1 | 8/2015 |
| WO | 2016156493 | A2 | 10/2016 |
| WO | 2016162446 | A1 | 10/2016 |
| WO | 2017055866 | A1 | 4/2017 |

OTHER PUBLICATIONS

"Cambridge Dictionary Sleeve Definition", available at <dictionary/Cambridge.org/dictionary/English/sleeve>, Feb. 9, 2019.
Canada Office Action, Application No. 2,878,973, mailed Jan. 22, 2016, 6 pages.
Canadian Office Action, Application No. 2,878,959, dated Jan. 18, 2016, 6 pages.
Chinese First Office Action for Chinese Application No. 200980152395.4 date issued Dec. 3, 2012, 16 pages (10 pages of English Translation and 6 pages of Official Copy).
Chinese Office Action and Chinese Search Report, Chinese Application No. CN201680020844.X, mailed Jun. 24, 2019, 22 pages.
Chinese Office Action and Search Report, Chinese Application No. 201680020842.0, mailed Jun. 21, 2019, 25 pages.
Chinese Office Action for Chinese Application No. 201480024978.X dated Jan. 18, 2017, 8 pages (5 pages of English Translation and 3 pages of Official Copy).
Chinese Office Action, Application No. 201480024988.3, dated Dec. 30, 2016, 26 pages (English Translation Only).
Chinese Office Action, Application No. 201480024988.3, dated Sep. 11, 2017, 10 pages (3 pages of English Translation and 7 pages of Official Copy).
Chinese Office Action, Application No. 201680020844.X, dated Jul. 2, 2019, 2 pages.
Chinese Office Action, Chinese Application No. 201380038055.5, dated Jul. 11, 2017, 3 pages.
Chinese Office Action, Chinese Application No. 201380038055.5, mailed Apr. 18, 2016, 9 pages.
Chinese Office Action, Chinese Application No. 201680020758.9, mailed Jul. 23, 2019, 21 pages.
Chinese Second Office Action and Search Report, Application No. 201680020844.X, dated May 22, 2020, 23 pages.
Christopher, Lord, Application and File History for U.S. Appl. No. 14/415,552, filed Jan. 16, 2015.
Christopher, Lord, Application and File History for U.S. Appl. No. 15/959,687, filed Apr. 23, 2018.
Communication pursuant to Article 94(3) EPC for European Application No. 16189742.6, mailed on Dec. 4, 2020, 9 pages.
Decision to Grant mailed Oct. 24, 2019 for Russian Application No. 2019118770, 11 pages.
Diener Electronic, "Plasma Polymerization", The Company Diener Electronic GmbH+Co. KG, www.plasma.de, Oct. 17, 2017, 19 Pages.
Dunn P and Reay D, "Heat Pipes", 4th edition, ISBN 0080419038, 1994, 14 Pages.
European Extended Search Report, Application No. 18195423.1, dated Jan. 29, 2019, 11 pages.
European Extended Search Report, Application No. 17189951.1, dated Jan. 4, 2018, 11 pages (3 pages of English Translation and 8 pages of Official copy).
European Notice of Opposition, Application No. EP2871984, dated Jun. 6, 2017, 17 pages.
European Search Report for European Application No. 15178588 dated Apr. 14, 2016, 2 pages.
European Search Report for European Application No. 16166656 dated Oct. 11, 2016, 9 pages (Official Copy Only).
European Search Report for European Application No. 16189742.6 mailed Mar. 17, 2017.
Exam Report from European Application 16189742.6-1006, dated Dec. 19, 2019, 8 pages.
Examination Report for Australian Application No. 2015293686, dated Jul. 25, 2018, 6 pages.
Examination Report for European Application No. 15741289.1, dated Jun. 15, 2018, 6 pages.
Extended European Search Report for Application No. 16177005.2, mailed on Oct. 26, 2016, 7 pages.
Extended European Search Report, European Application No. 19174777.3, mailed Nov. 11, 2019, 7 pages.
GB Search Report, Application No. GB1505593.2, mailed Sep. 22, 2015, 6 pages.
GB Search Report, GB Application No. GB1505595.7, mailed Oct. 20, 2015, 4 pages.
International Preliminary Report on Patentability for Appl. No. PCT/EP2016/057064, mailed on Oct. 12, 2017, 10 pages.
International Preliminary Report on Patentability for Application No. PCT/EP2016/057060, mailed on Jul. 12, 2017, 8 pages.
International Preliminary Report on Patentability for Application No. PCT/EP2016/057097, mailed on Oct. 12, 2017, 10 pages.
International Preliminary Report on Patentability for corresponding International Application No. PCT/GB2015/051213 mailed on Jul. 14, 2016, 20 pages.
International Preliminary Report on Patentability issued Aug. 13, 2013 for International Application No. PCT/AT2012/000017, 5 pages.
International Preliminary Report on Patentability, dated Apr. 22, 2014, for International Patent Application No. PCT/EP2012/070647, filed Oct. 18, 2012, 8 pages.
International Preliminary Report on Patentability, mailed Oct. 27, 2014, for Application No. PCT/EP2013/064952, filed Jul. 15, 2013.
International Preliminary Report on Patentability, mailed Oct. 31, 2014, for Application No. PCT/EP2013/064950, filed Jul. 15, 2013.
International Search Report and Written Opinion for Application No. PCT/EP2016/057097, mailed on Sep. 28, 2016, 14 pages.
International Search Report and Written Opinion for International Application No. PCT/EP2012/003103, mailed Nov. 26, 2012, 6 pages.
International Search Report and Written Opinion for PCT/GB2014/051333 mailed Jul. 17, 2014, 10 pages.
International Search Report and Written Opinion mailed Feb. 6, 2013 for PCT/EP2012/070647 filed Oct. 18, 2012, 9 pages.
International Search Report and Written Opinion received for PCT Patent Application No. PCT/AT2012/000017, mailed on Jul. 3, 2012, 13 pages (6 pages of English Translation and 7 pages of Official Copy).
International Search Report and Written Opinion, International Application No. PCT/GB2014/051332 mailed Jul. 21, 2014, 8 pages.
International Search Report and Written Opinion, International Application No. PCT/GB2014/051334 mailed Jul. 21, 2014, 8 pages.
International Search Report and Written Opinion, mailed Dec. 2, 2013, for Application No. PCT/EP2013/064950, filed Jul. 15, 2013.
International Search Report and Written Opinion, mailed Oct. 11, 2013, for Application No. PCT/EP2013/064952, filed Jul. 15, 2013.
International Search Report and Written Opinion, PCT Application No. PCT/EP2016/057064, mailed Oct. 19, 2016, 14 pages.
International Search Report for corresponding International Application No. PCT/GB2015/051213 mailed on Jul. 16, 2015, 5 pages.
International Search Report for International Application No. PCT/AT2009/000413 mailed on Jan. 25, 2010, 3 pages.

(56) References Cited

OTHER PUBLICATIONS

International Search Report for International Application No. PCT/AT2009/000414 mailed on Jan. 26, 2010, 2 pages.
International Search Report, International Application No. PCT/EP2016/057060, mailed Sep. 28, 2016, 7 pages.
IPRP mailed Aug. 5, 2015 for International Application No. PCT/GB2014/051333, 12 pages.
IPRP, International Application No. PCT/GB2014/051332 mailed Nov. 12, 2015, 7 pages.
IPRP, International Application No. PCT/GB2014/051334 mailed Nov. 12, 2015, 7 pages.
Japanese Notice of Reasons for Rejection for Japanese Application No. 2015-137361 mailing dated May 31, 2016, 6 pages (3 pages of English Translation and 3 pages of Official Copy).
Japanese Notice of Reasons for Rejection mailed Oct. 7, 2013 for Japanese Application No. 2011532464, 6 pages (3 pages of English Translation and 3 pages of Official Copy).
Japanese Notice of Reasons for Rejection mailed Sep. 8, 2015 for Japanese Application No. 2014179732, 5 pages (2 pages of English Translation and 3 pages of Official Copy).
Japanese Office Action for Japanese Application No. 2015-522066 dated Dec. 8, 2015, 3 pages.
Japanese Office Action, Application No. 2015-522066, 2 pages, dated Jan. 5, 2016.
Japanese Office Action, Application No. 2015-522064, dated Jan. 5, 2015, 2 pages.
Japanese Office Action, Application No. 2017-551218, dated Oct. 30, 2018, 4 pages.
Japanese Office Action, Application No. 2019-124231, mailed Oct. 27, 2020, 8 pages.
Japanese Office Action, Japanese Application No. 2015-522064, mailed Dec. 28, 2015, 2 pages.
Japanese Office Action, Japanese Application No. 2017-551205, mailed Oct. 2, 2018, 11 pages.
Japanese Office Action, Japanese Application No. 2017-551206, mailed Oct. 23, 2019, 8 pages.
Japanese Office Action, Japanese Application No. 2017551218, mailed Aug. 6, 2019, 16 pages.
Japanese Office Action, Japanese Application No. 2015-522065, dated Jan. 5, 2016, 2 pages.
Japanese Reasons for Rejection for Japanese Application No. 2016134648 mailed May 23, 2017, 18 pages (9 pages of English Translation and 9 pages of Official Copy).
Korean Decision for Refusal for Korean Application No. KR2020110006928 dated Jan. 10, 2019.
Korean Notice Trial Decision to Reject for Korean Application No. 10-2015-7001257 mailed Aug. 14, 2019, 17 pages.
Korean Office Action, Application No. 10-2015-7001256, dated Sep. 7, 2016, 11 pages.
Korean Office Action, Application No. 10-2015-7001257, dated Sep. 8, 2016, 15 pages.
Korean Office Action, Application No. 10-2017-7034160, dated Jul. 18, 2018, 16 pages.
Kynol, "Standard Specifications of Kynol Activated Carbon Fiber Products", published by Kynol., Sep. 19, 2013, 2 Pages.
Lord, et al., Application and File History for U.S. Appl. No. 14/415,540, filed Jan. 16, 2015.
Lord, et al., Application and File History for U.S. Appl. No. 15/914,139, filed Mar. 7, 2018.
Notice of Opposition Letter from EPO. Opposition against: EP2358418 dated Mar. 1, 2017, 60 pages.
Office Action dated Aug. 24, 2018 for Chinese Application No. 201580040255.3, 8 pages (Official Copy Only).
Office Action for Canadian Application No. 2,954,848, dated Dec. 18, 2017, 4 pages.
Office Action For Chinese Application No. 201811153475.9, mailed on Apr. 22, 2021, 17 pages.
Office Action for Japanese Application No. 2017-504040, dated Feb. 22, 2018, 7 Pages (3 Pages of English Translation and 4 Pages of Official Copy).
Office Action for Japanese Application No. 2017-504040, dated Oct. 9, 2018, 5 pages (2 pages of English Translation and 3 pages of Official Copy).
Office Action for Japanese Application No. 2018-206299, dated Apr. 13, 2021, 7 pages.
Office Action for Japanese Application No. 2018-206299, dated Oct. 6, 2020, 9 pages.
Office Action For Russian Application No. 2020124363, mailed on Feb. 17, 2021, 3 pages (Official Copy Only).
Office Action mailed Mar. 15, 2018 for Korean Application No. 2017-7002235, 14 pages (7 pages of English Translation and 7 pages of Official Copy).
Rudolph, G, "The Influence of CO2 on the Sensory Characteristics of the Favor-System", BAT Cigarettenfabriken GmbH, http://legacy.library.ucsf.edu/tid/sla51f00, 1987, 24 pages.
Russian Decision to Grant for Russian Application No. 2015100878 dated Sep. 19, 2016.
Russian Decision to Grant, Application No. 2015100881/12, dated Apr. 6, 2016, 8 pages.
Russian Office Action, Application No. 2015146847/12, dated Sep. 22, 2017, 11 pages (Official Copy Only).
Russian Office Action, Application No. 2014120213/12, dated Oct. 26, 2016, 7 pages (Official Copy Only).
Russian Office Action, Russian Application No. 2018118998, mailed Sep. 24, 2018, 6 pages.
Russian Search Report for Russian Application No. 2015146843/12 (072088) date completed Apr. 24, 2017, 3 pages (English Translation Only).
Search Report mailed May 17, 2020 for Chinese Application No. 201680020844.X, 4 pages.
Search Report mailed Jan. 15, 2018, for Japanese Application No. 2017-504040, 15 pages (7 pages of English Translation and 8 pages of Official Copy).
Search Report, GB Application No. GB1505597.3, mailed Oct. 7, 2015, 3 pages.
Sutton, Application and File History for U.S. Appl. No. 15/563,065, filed Sep. 29, 2017.
Sutton, et al., Application and File History for U.S. Appl. No. 15/563,078, filed Sep. 29, 2017.
Sutton, et al., Application and File History for U.S. Appl. No. 15/563,086, filed Sep. 29, 2017.
Translation of Chinese Second Office Action for Chinese Application No. 200980152395.4 date issued Aug. 20, 2013, 16 pages (10 pages of English Translation and 6 pages of Official Copy).
Written Opinion for Application No. PCT/EP2016/057060, mailed on Sep. 28, 2016, 8 pages.
Written Opinion of the International Preliminary Examining Authority for International Application No. PCT/GB2015/051213 mailed on Mar. 29, 2016, 9 pages.
Written Opinion, International Application No. PCT/EP2016/057060, mailed Apr. 7, 2017, 6 pages.

* cited by examiner

CARTRIDGE, POUCH AND METHOD OF MANUFACTURE OF POUCH FOR USE WITH APPARATUS FOR HEATING SMOKABLE MATERIAL

RELATED APPLICATIONS

This application is a continuation application of Ser. No. 15/563,078 filed Sep. 29, 2017, which is in turn a National Phase entry of PCT Application No. PCT/EP2016/057060, filed Mar. 31, 2016, which claims priority from GB Patent Application No. 15055595.7, filed Mar. 31, 2015, each of which is hereby fully incorporated herein by reference.

TECHNICAL FIELD

The present disclosure relates to a cartridge for use with apparatus for heating smokable material to volatilize at least one component of the smokable material, to a pouch for use with apparatus for heating smokable material to volatilize at least one component of the smokable material, and to a method of manufacturing a pouch for use with apparatus for heating smokable material.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

According to a first aspect of the present disclosure, there is provided a cartridge for use with apparatus for heating smokable material to volatilize at least one component of the smokable material, the cartridge comprising: a housing defining a chamber; and a pouch containing smokable material, wherein: the pouch is located within the chamber; at least part of the pouch is made of porous material for permitting aerosol or volatilized material generated within the pouch to pass out of the pouch from within the pouch; the pouch defines part of an exterior surface of the cartridge; the exterior surface of the cartridge comprises a cavity for receiving in use a heating device for heating the smokable material; and the pouch defines at least part of the cavity.

In an exemplary embodiment, the pouch is a first pouch that defines a first part of the cavity; the cartridge comprises a second pouch that contains smokable material and defines a second part of the cavity; and at least part of the second pouch is made of porous material for permitting aerosol or volatilized material generated within the second pouch to pass out of the second pouch from within the second pouch.

In an exemplary embodiment, the first and second pouches define opposite sides of the cavity.

In an exemplary embodiment, the first pouch is unitary with the second pouch.

In an exemplary embodiment, the cavity has a mouth and a longitudinal axis, and a cross-sectional size of the cavity perpendicular to the axis decreases with distance from the mouth over at least a majority of a length of the cavity.

In an exemplary embodiment, the cross-sectional size of the cavity decreases with distance from the mouth over the full length of the cavity.

In an exemplary embodiment, the pouch comprises a first wall made of a first material, and a second wall made of a second material that is a different material to the first material; and the smokable material is arranged between the first wall and the second wall.

In an exemplary embodiment, the second wall is porous for permitting aerosol or volatilized material generated within the pouch to pass out of the pouch from within the pouch, and the first wall is less porous to the aerosol or volatilized material than the second wall.

In an exemplary embodiment, the first wall comprises one or more materials selected from the group consisting of: foil, paper, a polymer, a plastics material, and a combination of foil and paper.

In an exemplary embodiment, the pouch is attached to the housing.

In an exemplary embodiment, the pouch is attached to the housing by an adhesive.

In an exemplary embodiment, the housing comprises a first housing part connected to a second housing part, and a portion of the pouch is trapped between the first housing part and the second housing part so as to attach the pouch to the housing.

In an exemplary embodiment, the housing has an air flow inlet extending therethrough for admitting air into the chamber from an exterior of the housing.

In an exemplary embodiment, the housing has a volatilized material outlet extending therethrough for permitting aerosol or volatilized material generated within the pouch to pass from the chamber out of the housing.

In an exemplary embodiment, the cartridge comprises a mass of aerosol containment material within the chamber.

In an exemplary embodiment, the pouch contains the mass of aerosol containment material.

In an exemplary embodiment, the aerosol containment material comprises one or more materials selected from the group consisting of: wadding, fleece, non-woven material, non-woven fleece, woven material, knitted material, nylon, foam, polystyrene, polyester, polyester filament, polypropylene, and a blend of polyester and polypropylene.

In an exemplary embodiment, at least part of the pouch comprises one or more materials selected from the group consisting of: fleece, viscose, non-woven material, non-woven fleece, woven material, knitted material, nylon, and polyester.

In an exemplary embodiment, the smokable material comprises tobacco.

In an exemplary embodiment, the smokable material comprises an aerosol forming agent.

In an exemplary embodiment, the aerosol forming agent comprises glycerol.

According to a second aspect of the present disclosure, there is provided a pouch for use with apparatus for heating smokable material to volatilize at least one component of the smokable material, the pouch comprising: a first wall made of a first material; and a second wall made of a second material that is a different material to the first material; wherein the pouch contains smokable material between the first wall and the second wall.

In an exemplary embodiment, the second wall is porous for permitting aerosol or volatilized material generated within the pouch to pass out of the pouch from within the pouch, and the first wall is less porous to the aerosol or volatilized material than the second wall.

In an exemplary embodiment, the second material comprises one or more materials selected from the group consisting of: fleece, viscose, non-woven material, non-woven fleece, woven material, knitted material, nylon, and polyester.

In an exemplary embodiment, the first wall comprises one or more materials selected from the group consisting of: foil, paper, a polymer, a plastics material, and a combination of foil and paper.

In an exemplary embodiment, the smokable material comprises tobacco.

In an exemplary embodiment, the smokable material comprises an aerosol forming agent.

In an exemplary embodiment, the aerosol forming agent comprises glycerol.

According to a third aspect of the present disclosure, there is provided a method of manufacturing a pouch for use with apparatus for heating smokable material to volatilize at least one component of the smokable material, the method comprising: providing a first wall made of a first material, and a second wall made of a second material that is a different material to the first material; and attaching the first wall to the second wall with the smokable material between the first wall and the second wall.

In an exemplary embodiment, the method comprises depositing the smokable material onto the second wall, and then attaching the first wall to the second wall with the smokable material between the first wall and the second wall.

In an exemplary embodiment, the second wall defines a pocket, and the depositing comprises depositing the smokable material into the pocket.

In an exemplary embodiment, the depositing comprises depositing the smokable material and aerosol containment material into the pocket.

In an exemplary embodiment, the second wall is porous for permitting aerosol or volatilized material generated within the pouch to pass out of the pouch from within the pouch, and the first wall is less porous to the aerosol or volatilized material than the second wall.

In an exemplary embodiment, the second material comprises one or more materials selected from the group consisting of: fleece, viscose, non-woven material, non-woven fleece, woven material, knitted material, nylon, and polyester.

In an exemplary embodiment, the first wall comprises one or more materials selected from the group consisting of: foil, paper, a polymer, a plastics material, and a combination of foil and paper.

In an exemplary embodiment, the smokable material comprises tobacco.

BRIEF DESCRIPTION OF THE DRAWINGS

Embodiments of the disclosure will now be described, by way of example only, with reference to the accompanying drawings, in which.

DETAILED DESCRIPTION

As used herein, the term "smokable material" includes materials that provide volatilized components upon heating, typically in the form of an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, gel or agglomerates. "Smokable material" also may include other, non-tobacco, products, which, depending on the product, may or may not contain nicotine.

Figure 1:
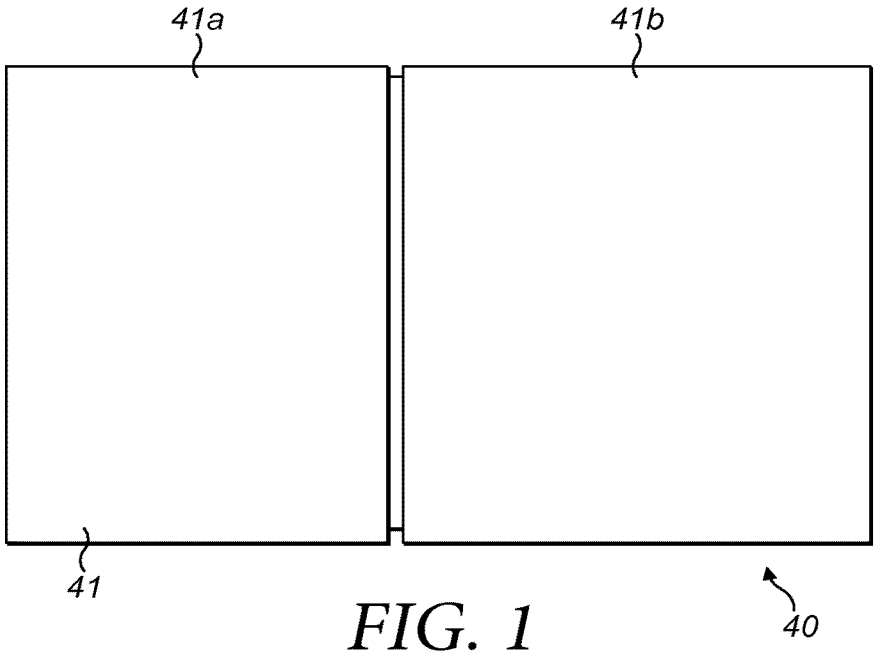
FIG. 1 shows a schematic top view of an example of a cartridge for use with apparatus for heating smokable material to volatilize at least one component of the smokable material.
Figure 2:
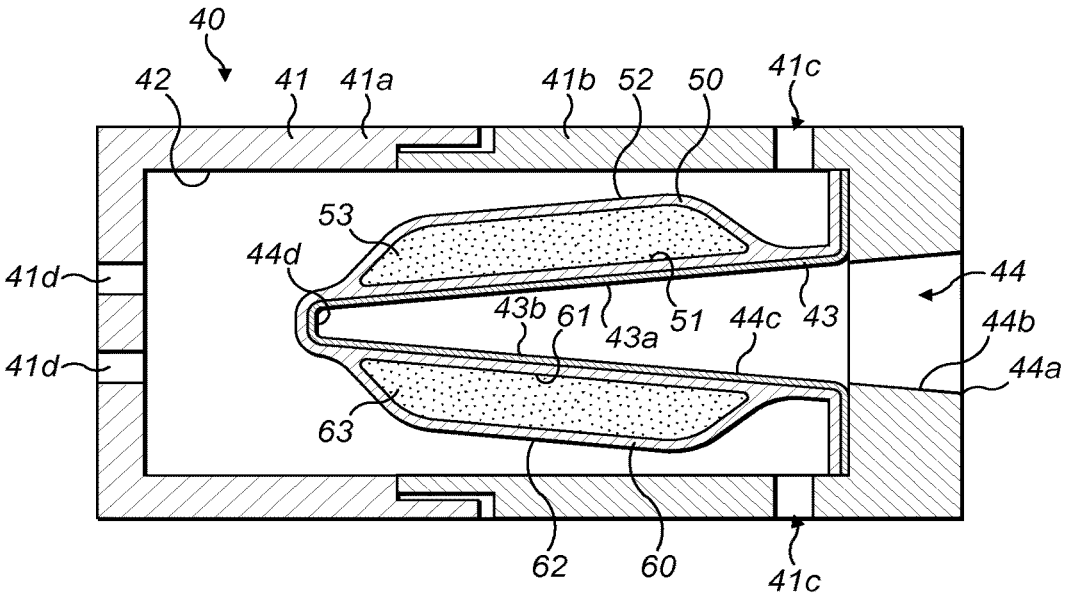
FIG. 2 shows a schematic cross-sectional view of the cartridge of FIG. 1.

Referring to FIGS. 1 and 2, there are shown a schematic top view and a schematic cross-sectional view of an example of a cartridge 40 according to an embodiment of the invention.

The cartridge 40 of this embodiment comprises a housing 41 defining a chamber 42. In this embodiment, the housing 41 comprises a first housing part 41*a* and a second housing part 41*b* that is non-unitary with the first housing part 41*a*. The first housing part 41*a* is attached to the second housing part 41*b*, such as by a snap-fit connection, adhesive, or the like. In other embodiments, the housing 41 may take a different form. For example, in some embodiments the first and second housing parts 41*a*, 41*b* may be unitary, such as following welding, e.g. sonic welding. In some embodiments, the first and second housing parts 41*a*, 41*b* may be unitary and connected by a living hinge. The first and second housing parts 41*a*, 41*b* may be made of any suitable material, such as a plastics material.

The cartridge 40 further comprises a first pouch 50 and a second pouch 60. In this embodiment, the first pouch 50 is unitary with the second pouch 60, and together the first and second pouches are referred to herein as an assembly of the pouches 50, 60. However, in other embodiments, the first pouch 50 may be non-unitary with the second pouch 60. Each of the pouches 50, 60 contains smokable material 53, 63. Each of the pouches 50, 60 comprises a first wall 51, 61 and a second wall 52, 62, and in each pouch 50, 60 the smokable material 53, 63 is arranged between the first wall 51, 61 and the second wall 52, 62. In this embodiment, the first wall 51, 61 of each of the pouches 50, 60 is made of a first material, and the second wall 52, 62 of each of the pouches 50, 60 is made of a second material that is a different material to the first material. However, in other embodiments, the first and second walls 51, 52, 61, 62 may be made of the same material, such as the second material.

In this embodiment, part of each of the pouches 50, 60 is made of porous material for permitting aerosol or volatilized material generated within the pouch 50, 60 on heating the smokable material 53, 63 to pass out of the pouch 50, 60 from within the pouch 50, 60. In this embodiment, in each pouch 50, 60, the second wall 52, 62 is made of such a porous material, and the first wall 51, 61 is made of a material that is less porous to the aerosol or volatilized material than the porous material. Therefore, in this embodiment, in each pouch 50, 60, the second wall 52, 62 is porous for permitting aerosol or volatilized material generated within the pouch 50, 60 to pass out of the pouch 50, 60, and the first wall 51, 61 is less porous to the aerosol or volatilized material than the second wall 52, 62. However, in other embodiments, each of the first and second walls 51, 52, 61, 62 of the pouches 50, 60 may be made of porous material for permitting the aerosol or volatilized material to pass out of the pouch 50, 60. The porous material may, for example, comprise one or more materials selected from the group consisting of: fleece, viscose, non-woven material, non-woven fleece, woven material, knitted material, nylon, and polyester. The first material may comprise one or more of a foil, a metal foil, a non-metal foil, paper, a polymer, a plastics material, or a combination of foil and paper, such as paper overlaid with foil, or the like.

Each of the pouches 50, 60 is located within the chamber 42. In this embodiment, each of the pouches 50, 60 is attached to the housing 41. More specifically, in this embodiment, each of the pouches 50, 60 is attached to an inner surface of the second housing part 41*b*, such as by an adhesive or by pinning. In one embodiment, the method of manufacturing the cartridge 40 comprises attaching the pouches 50, 60 to the inner surface of the second housing part 41*b*, and then attaching the first housing part 41*a* to the second housing part 41*b* to surround the pouches 50, 60 within the housing 41. However, in other embodiments, one or each of the pouches 50, 60 may be attached to the housing 41 in a different manner. For example, in some embodiments, one or each of the pouches 50, 60 may have a portion that is trapped between the first housing part 41*a* and the second housing part 41*b* so as to attach the or each pouch 50, 60 to the housing 41. In some embodiments, one or both of the pouches 50, 60 may not be attached to the housing 41.

In this embodiment, the assembly of the pouches 50, 60 comprises a carrier 43. The first walls 51, 61 of the first and second pouches 50, 60 comprise respective first and second portions 43*a*, 43*b* of the carrier 43. The carrier 43 may act to support the rest of the first and second pouches 50, 60. In some embodiments, the carrier 43 is more rigid or robust than each of the second walls 52, 62 of the first and second pouches 50, 60. The carrier 43 is thermally-conductive and is for conducting heat from the cavity 44 to the smokable material 53, 63 in the pouches 50, 60. In this embodiment, the carrier 43 comprises a metal foil, such as aluminum foil, but in other embodiments the carrier 43 may comprise one or more materials selected from the group consisting of: foil, paper, a polymer, a plastics material, and a combination of foil and paper. In some embodiments, the carrier 43 may be omitted, or may not be part of the assembly of the pouches 50, 60 as such.

An exterior surface of the cartridge 40 comprises a cavity 44 for receiving a heating device for heating the smokable material 53, 63. In an embodiment, the cavity 44 in use receives a heater of an apparatus that has a heater which is engaged in use by the cartridge. The "exterior surface" may be a surface that envelops the rest of the cartridge 40, or that delineates the cartridge 40. The exterior surface of the cartridge 40 comprises a portion that is recessed to provide the cavity 44. In this embodiment, each of the pouches 50, 60 defines part of the cavity 44. That is, the first pouch 50 defines a first part of the cavity 44, and the second pouch 60 defines a second part of the cavity 44. Accordingly, in this embodiment, each of the pouches 50, 60 defines part of the exterior surface of the cartridge 40. In this embodiment, the first walls 51, 61 of the pouches 50, 60 define the first and second parts, respectively, of the cavity 44. More specifically, the first and second portions 43*a*, 43*b* of the carrier 43 define the first and second parts, respectively, of the cavity 44. In this embodiment, the first and second parts of the cavity 44 are opposite sides of the cavity 44, so that the cavity 44 is located between the first and second pouches 50, 60. In another embodiment that is a variant of this embodiment, the second pouch 60 may be omitted. In such a variant, the first wall 51 of the pouch may define part of the cavity 44, and the rest of the cavity 44 may be defined by one or more further elements.

In this embodiment, the cavity 44 has a mouth 44*a*, first and second trunk sections 44*b*, 44*c*, and a closed end 44*d*. The first trunk section 44*b* connects the mouth 44*a* to the second trunk section 44*c*, and the second trunk section 44*c* connects the first trunk section 44*b* to the closed end 44*d*. The cavity 44 has a length that is measured from the mouth 44*a* to the closed end 44*d*, and that extends along an axis of the cavity 44. In this embodiment, the second housing part 41*b* defines the mouth 44*a* and a first trunk section 44*b*, whereas the pouches 50, 60 define the second trunk section 44*c* and the closed end 44*d*.

In this embodiment, the pouches 50, 60 and the second housing part 41*b* are shaped and relatively positioned so that the cavity 44 is a wedge-shaped cavity 44. In this embodiment, the wedge-shaped cavity 44 is symmetrical or rotationally-symmetrical. In other embodiments, it may instead be asymmetrical. A cross-sectional size (for example, a width, a height, a diameter, a dimension, or an area) of the cavity 44 decreases with distance from the mouth 44*a* over the full length of the cavity 44 from the mouth 44*a* to the closed end 44*d*. In this embodiment, the cross-sectional size of the cavity 44 decreases at a linear rate with distance from the mouth 44*a*. In other embodiments, the rate may be non-linear. For example, in some embodiments, the cross-sectional size (for example, a width, a height, a diameter, a dimension, or an area) of the first trunk section 44*b* may decrease at a first rate with distance from the mouth 44*a*, whereas the cross-sectional size (for example, a width, a height, a diameter, a dimension, or an area) of the second trunk section 44*c* may decrease at a second, different rate with distance from the first trunk section 44*b*. The second rate may be more than the first rate.

The tapered profile may help a user to guide the heating device into the cavity 44. By providing that the cross-sectional size of the cavity 44 decreases with distance from the mouth 44*a* over the full length of the cavity 44, the heating device may be introducible into the cavity 44 in a direction non-parallel to the first walls 51, 61 of the pouches 50, 60. Therefore, the heating device may be a close fit with the first walls 51, 61 of the pouches 50, 60 in use. This provides good conduction of heat from the heating device to the pouches 50, 60 and the smokable material 53, 63, yet rubbing of the heating device against the pouches 50, 60 during such insertion of the heating device may be minimized or avoided. This can help reduce or avoid the pouches 50, 60 being torn or otherwise damaged by insertion of the heating device, and reduces wear of the heating device.

In some other embodiments, the pouches 50, 60 and the second housing part 41*b* may be shaped and relatively positioned so that the cavity 44 is other than wedge-shaped, such as dome-shaped. Such a dome-shaped cavity may be symmetrical or rotationally-symmetrical, or asymmetrical.

In some embodiments, the cavity 44 may be of constant, or substantially constant, cross-sectional shape and size (for example, a width, a height, a diameter, a dimension, or an area) over a majority, or only a majority, of the length of the cavity 44.

In this embodiment, air flow inlets 41*c* extend through the second housing part 41*b* for admitting air into the chamber 42 from an exterior of the housing 41. In other embodiments, there may be only one air flow inlet 41*c* in place of the plurality of air flow inlets 41*c*, or the air flow inlet(s) 41*c* may take some other form and/or may extend through a different part of the housing 41.

In this embodiment, apertures 41*d* extend through the first housing part 41*a*. Each of the apertures 41*d* is a volatilized material outlet 41*d* for permitting volatilized material generated within the pouches 50, 60 by heating of the smokable material 53, 63 to pass from the chamber 42 out of the housing 41. In other embodiments, there may be only one aperture 41*d* in place of the plurality of apertures 41*d*, or the volatilized material outlet(s) 41*d* may take some other form and/or may extend through a different part of the housing 41.

In some embodiments, one or each of the pouches 50, 60 contains a mass of aerosol containment material. The mass of aerosol containment material is a porous material for the containment of aerosol generated in the pouches 50, 60 in use by heating the smokable material 53, 63. In some embodiments, in each of the pouches 50, 60 the mass of aerosol containment material may be located between the smokable material 53, 63 and the second wall 52, 62 of the pouch 50, 60. In some embodiments, the smokable material 53, 63 is in contact with the mass of aerosol containment material. In other embodiments, one or each of the pouches 50, 60 may itself comprise a mass of aerosol containment material. For example, in some embodiments, the second wall 52, 62 of one or each of the pouches 50, 60 may comprise a mass of aerosol containment material. The aerosol containment material may comprise wadding or fleece, such as with a density of about 100 gsm or about 120 gsm. Other aerosol containment materials that may be used in other embodiments are discussed below. In some embodiments, the mass of aerosol containment material may be omitted from the cartridge 40.

The cartridge 40 shown in FIGS. 1 and 2 is usable with an apparatus (not shown) for heating the smokable material 53, 63 to volatilize at least one component of the smokable material. In some embodiments, the apparatus is for heating the smokable material 53, 63 of the cartridge 40 to volatilize at least one component of the smokable material 53, 63 without combusting, or burning, the smokable material.

In some respective embodiments, the apparatus comprises a heating device for contacting, or for coming into close proximity to, the pouches 50, 60 of the cartridge 40. In some embodiments, the heating device has a surface profile that matches, or closely matches, a surface profile of the first walls 51, 61 of the pouches 50, 60, or matches, or closely matches, a surface profile of the cavity 44. This helps provide good conduction of heat from the heating device to the carrier 43, and the smokable material 53, 63 contained in the pouches 50, 60.

In some embodiments, the apparatus comprises a controller for controlling heating of the heating device so as to cause heating of the smokable material 53, 63 to volatilize the at least one component of the smokable material 53, 63 without combusting the smokable material 53, 63. In some embodiments, the controller is for controlling the supply of power from a power source to the heating device. In some embodiments, the controller is configured to ensure that the temperature of the heating device remains within a temperature range of about 150 degrees Celsius to about 300 degrees Celsius, or about 170 degrees Celsius to about 220 degrees Celsius. In some embodiments, within this temperature range, the smokable material 53, 63 of the cartridge 40 is heated sufficiently to volatilize at least one component of the smokable material 53, 63 without combusting the smokable material 53, 63. In other embodiments, the temperature range of heating may be other than this range. In some embodiments, following the volatilization of the at least one component of the smokable material 53, 63, an aerosol for inhalation by a user is formed. For example, a user drawing on an outlet of the apparatus may draw air through the apparatus, which cools the volatilized component(s) of the smokable material 53, 63 so that they condense to form the aerosol.

In some embodiments, the heating device of the apparatus may comprise a first heater and a second heater. When the heating device is in the cavity 44 of the cartridge 40, the first heater may be closer to the smokable material 53 contained in the first pouch 50 than to the smokable material 63 contained in the second pouch 60, and the second heater may be closer to the smokable material contained in the second pouch 60 than to the smokable material 53 contained in the first pouch 50. Therefore, in use, the first heater may be predominantly for heating the smokable material 53 contained in the first pouch 50, and the second heater may be predominantly for heating the smokable material contained in the second pouch 60. The controller of the apparatus may be for controlling the supply of power from the power source to the first heater independently of the supply of power from the power source to the second heater. The manner in which the controller causes the first and second heaters to be heated may be selectable by a user. Thus, in some embodiments, a user may be able to select which of the first and second heaters is to be heated, and thus which of pouches is predominantly to be heated. In embodiments in which the first and second pouches 50, 60 contain different forms or compositions of smokable material 53, 63, a user may thus be able to select or configure the type of aerosol they wish to generate, and thus the experience they wish to have on inhaling the aerosol.

Referring to FIGS. 3-6, a method for manufacturing the assembly of the first and second pouches 50, 60 of the cartridge 40 shown in FIGS. 1 and 2 will be described. In summary, the method comprises providing a first body 151 made of a first material and a second body 152 made of a second material that is a different material to the first material; depositing the smokable material 53, 63 onto the second body 152 in discrete quantities; and then attaching the first body 151 to the second body 152 with the discrete quantities of smokable material 53, 63 between the first body 151 and the second body 152, so as to form pouches 50, 60 containing the respective discrete quantities of smokable material 53, 63 between the first and second bodies 151, 152. In the manufactured assembly, the first wall 51, 61 of each of the pouches 50, 60 is provided by part of the first body 151, and the second wall 52, 62 of each of the pouches 50, 60 is provided by part of the second body 152.

Figure 3:
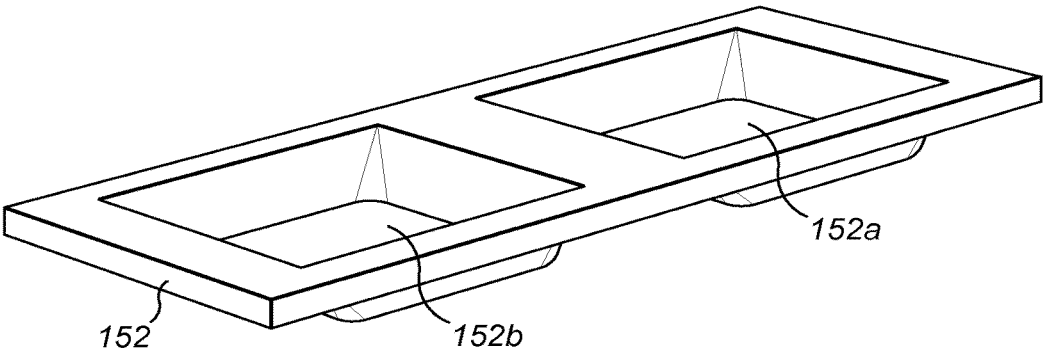
FIG. 3 shows a schematic perspective view of a second body of a second material used in a method of manufacturing an assembly of pouches.
Figure 4:
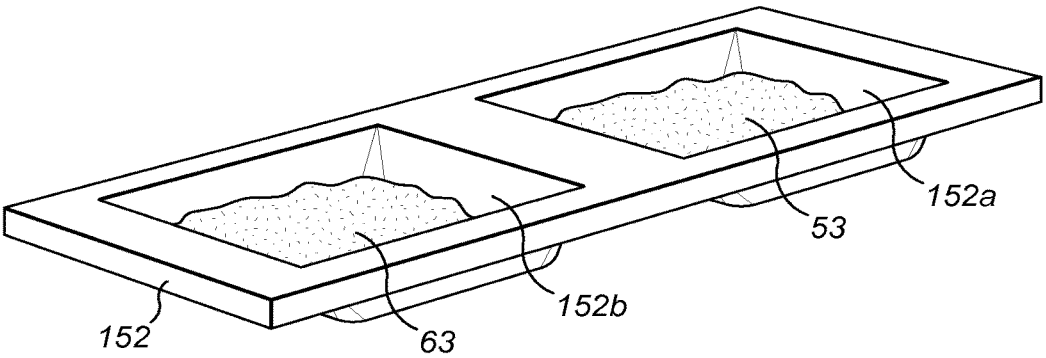
FIG. 4 shows a schematic perspective view of the second body of FIG. 3 and smokable material deposited in pockets defined by the second body.
Figure 5:
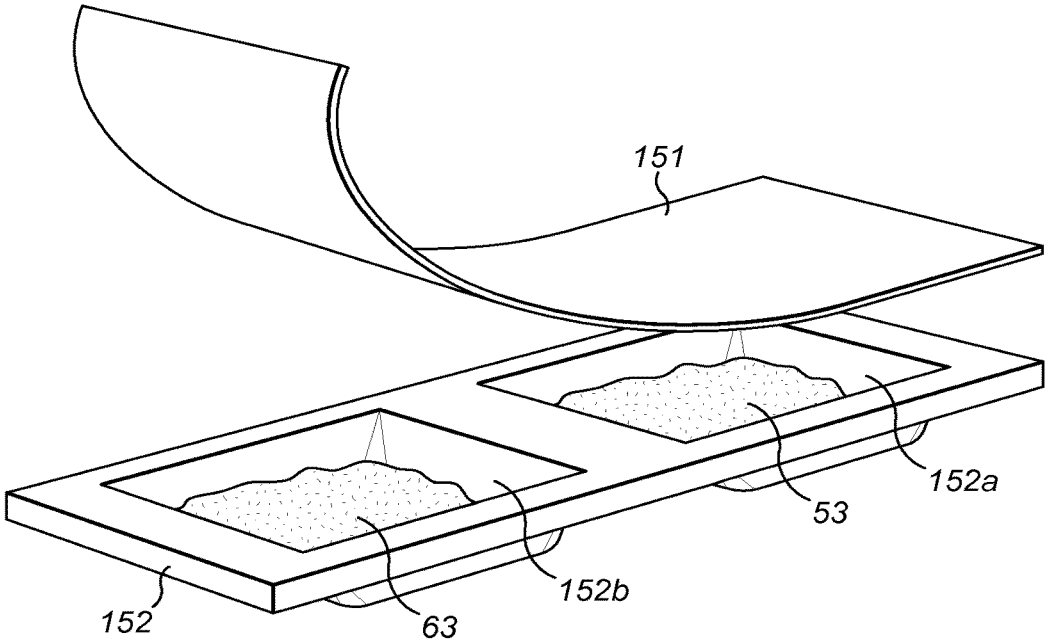
FIG. 5 shows a schematic perspective view of a first body of a first material being attached to the second body of FIG. 4 with the smokable material between the first body and the second body.
Figure 6:
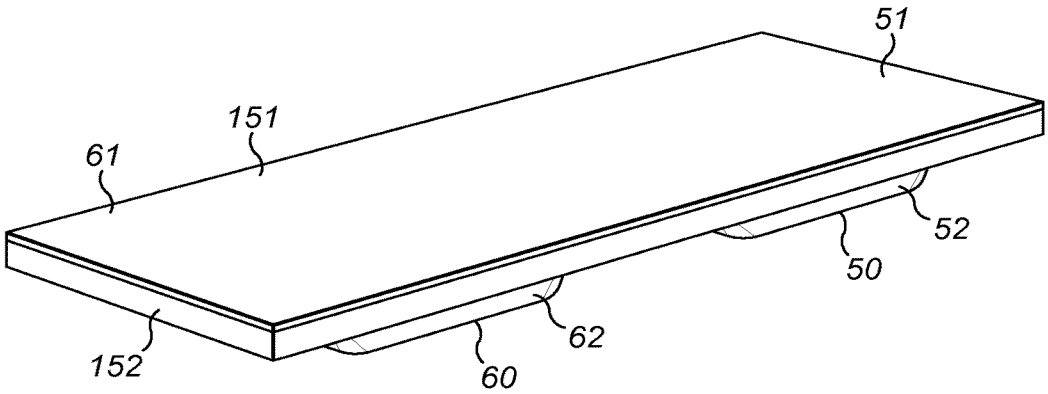
FIG. 6 shows a schematic perspective view of the manufactured assembly of pouches.

As shown in FIG. 3, in this embodiment the second body 152 defines a plurality of pockets 152*a*, 152*b* for receiving the discrete quantities of smokable material 53, 63. In this embodiment, the smokable material 53, 63 is deposited in the pockets 152*a*, 152*b*, as shown in FIG. 4. Then, the first body 151 is attached to the second body 152 with the smokable material 53, 63 in the pockets 152*a*, 152*b*, as shown in FIG. 5. After the first body 151 has been so attached to the second body 152, the smokable material 53, 63 is contained between the first and second bodies 151, 152 and in the pouches 50, 60 of the assembly so formed, as shown in FIG. 6. In some embodiments, the smokable material 53, 63 and aerosol containment material, such as any of the aerosol containment materials discussed herein, may be deposited in the pockets 152*a*, 152*b*. In some embodiments, the second body 152 may not define such pockets 152*a*, 152*b*, and the smokable material 53, 63 may be deposited on the second body 152 in discrete quantities. In some embodiments, the smokable material 53, 63 may be provided between the first and second bodies 151, 152 in some other manner, such as by being deposited on the first body 151 before the second body 152 is attached to the first body 151.

In some embodiments of the method, after the first body 151 has been attached to the second body 152 to contain the smokable material 53, 63 between the first and second bodies 151, 152, the method may comprise cutting through the first and second bodies 151, 152 between adjacent pouches 50, 60. The spacing of the cuts may, for example, be to define both the first and second pouches 50, 60 between successive cuts, or to define only one pouch 50, 60 between successive cuts. In another embodiment of the method, one of the pouches 50, 60 may be manufactured in isolation. That is, the pouch 50, 60 may never be unitary with another pouch 50, 60.

According to the embodiment of the method described above with reference to FIGS. 3-6, a pouch 50, 60 is manufactured by providing a first wall 51, 61 made of a first material and a second wall 52, 62 made of a second material that is a different material to the first material; and attaching the first wall 51, 61 to the second wall 52, 62 with the smokable material 53, 63 between the first wall 51, 61 and the second wall 52, 62. In this embodiment, the smokable material 53, 63 is deposited into a pocket 152*a*, 152*b* defined by the second wall 52, 62, and then the first wall 51, 61 is attached to the second wall 52, 62 with the smokable material between the first wall 51, 61 and the second wall 52, 62. The other embodiments of the method described above also result in the manufacture of a pouch 50, 60.

In each of the above-described methods, the second material is a porous material for permitting aerosol or volatilized material generated within the manufactured pouch 50, 60 to pass out of the pouch 50, 60 from within the pouch 50, 60, and the first material is a material that is less porous to the aerosol or volatilized material than the porous material. The second material may comprise one or more materials selected from the group consisting of: fleece, viscose, non-woven material, non-woven fleece, woven material, knitted material, nylon, and polyester. The first material may comprise one or more materials selected from the group consisting of: foil, paper, a polymer, a plastics material, and a combination of foil and paper. In other embodiments, the first body 151 or first wall 51, 61 may be made of the second material.

In each of the above described embodiments, the smokable material 53, 63 comprises tobacco. However, in respective variations to each of these embodiments, the smokable material 53, 63 may consist of tobacco, may consist substantially entirely of tobacco, may comprise tobacco and smokable material other than tobacco, may comprise smokable material other than tobacco, or may be free of tobacco. In some embodiments, the smokable material 53, 63 may include an aerosol forming agent, such as glycerol.

In the above-described embodiments in which aerosol containment material is present in the cartridge 40, the aerosol containment material comprises wadding or fleece with a density of about 100 gsm or about 120 gsm. In other embodiments, the density of the aerosol containment material may be different. However, if the density is too high, the aerosol containment material may act as a filter and attenuate generated aerosol. Alternatively, if the density is too low, the aerosol containment material may not provide effective aerosol containment. An appropriate density, particularly when the aerosol containment material comprises wadding or fleece, may be between about 60 and about 140 gsm, or between about 80 and about 120 gsm. In some embodiments, the aerosol containment material may have a thickness within a range of 1 mm to 2 mm.

In still further embodiments, the aerosol containment material may comprise one or more materials selected from the group consisting of: wadding, fleece, non-woven material, non-woven fleece, woven material, knitted material, nylon, foam, polystyrene, polyester, polyester filament, polypropylene, and a blend of polyester and polypropylene. When a material other than wadding or fleece is used, the material would have a density chosen to have similar thermal properties to wadding or fleece having a density of from about 80 to about 120 gsm. In each of the above-described embodiments of the cartridge or pouch, the aerosol containment material is free of smokable material. However, this need not always be the case.

In some embodiments, the mass of aerosol containment material is heat resistant at least over the expected range of temperatures of the heating device 20 of the apparatus that will arise in operation, such as for example 150 to 300 degrees Celsius or 170 to 220 degrees Celsius as discussed above, and will not degrade when subjected to such operation temperatures.

In some embodiments, the aerosol containment material helps to ensure that volatilized material generated in the pouch in use does not condense on an inner surface of the housing 41 of the cartridge 40. In some embodiments, the provision of the mass of aerosol containment material helps to increase the surface area on which aerosol generated in the pouch in use may form. In some embodiments, such a mass of aerosol containment material helps to increase the amount of visible aerosol generated in, or emitted from, the pouch in use, and thus may enhance the consumer experience.

As discussed above, in some embodiments the aerosol containment material may be omitted.

In each of the above embodiments, the cartridge 40 is a consumable cartridge. Once all, or substantially all, of the volatile component(s) of the smokable material in the cartridge has/have been spent, the user may remove the cartridge from the apparatus and dispose of the cartridge. The user may subsequently re-use the apparatus with another of the cartridges 40. However, in other respective embodiments, the cartridge 40 may be non-consumable, and the combination of the apparatus and the cartridge 40 may be disposed of together once the volatile component(s) of the smokable material has/have been spent.

In some embodiments, the apparatus discussed above may be sold, supplied or otherwise provided separately from the cartridge 40 with which the apparatus is usable. However, in other embodiments, the apparatus and one or more of the cartridges 40 may be provided together as a kit.

Figure 7:
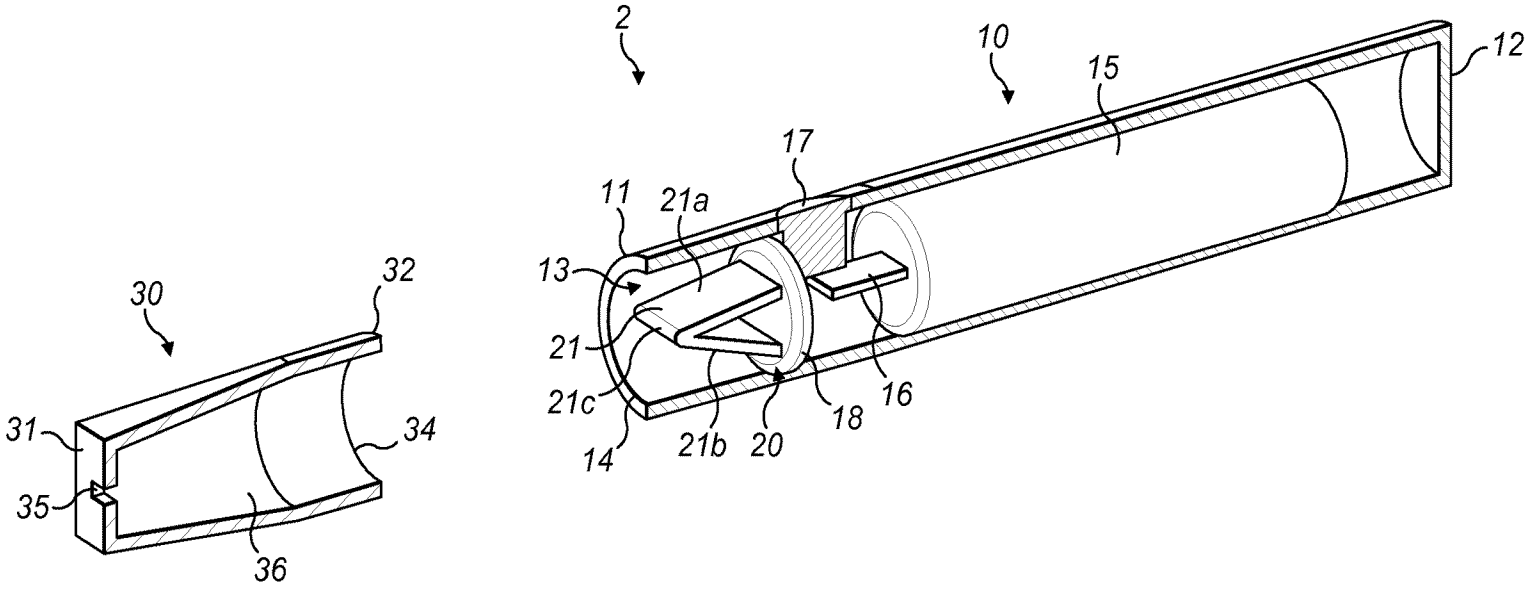
FIG. 7 shows a partially cut-away perspective view of an example of an apparatus for heating smokable material to volatilize at least one component of the smokable material.

Referring to FIG. 7, there is shown a partially cut-away perspective view of an example of an apparatus 2 for heating smokable material to volatilize at least one component of the smokable material. The apparatus 2 is particularly suitable for use with a cartridge 40 as described above. The apparatus 2 has a body 10 which is generally tubular and elongate, has first and second opposite longitudinal ends 11, 12, and defines an interface for co-operating with the cartridge 40. In this embodiment, the interface comprises a recess 13 for receiving the cartridge 40. In other embodiments, the interface can take a different form, such as a shelf, a surface, or a projection, and optionally requires mechanical mating with the cartridge 40 in order to cooperate with the cartridge 40. The first longitudinal end 11 of the body 10 defines an opening 14 into the recess 13 at a first end of the recess 13. The opening 14 is shaped and sized so that the cartridge 40 is movable through the opening 14 to allow a user to insert the cartridge 40 into the recess 13 and/or to remove the cartridge 40 from the recess 13.

The apparatus 2 has a heating device 20. In the example shown the heating device 20 has a wedge-shape heater 21 which projects into the recess 13. The apparatus 2 shown also has electrical components such as an electrical power source 15 (such as a rechargeable or non-rechargeable battery), a controller 16 and an actuator 17 for enabling user activation of the heater 21. The wedge-shape heater 21 can be inserted into the cavity 44 of the cartridge to heat the carrier 43. In an embodiment, the wedge-shape heater 21 fits snugly in the cavity 44 for efficient heat transfer to the carrier 43 and the smokable material 53, 63.

In this embodiment, the heater 21 is a folded heater 21 comprising a first heater portion 21*a* and a second heater portion 21*b*. The heater 21 has a fold 21*c* therein, and the first heater portion 21*a* is connected to the second heater portion 21*b* at the fold 21*c*. The fold 21*c* forms a distal end of the heater 21, which distal end is distal from the retainer 18. The first heater portion 21*a* defines an upper surface of the heater 21, and the second heater portion 21*b* defines a lower surface of the heater 21. In this embodiment, the first and second heater portions 21*a*, 21*b* lie substantially in respective first and second planes, and the first and second planes meet at an acute angle.

In this embodiment, the apparatus 2 has a mouthpiece 30 which is generally tubular and elongate and has first and second opposite longitudinal ends 31, 32. The mouthpiece 30 comprises an inlet 34 at the second longitudinal end 32 of the mouthpiece 30, an outlet 35 at the first longitudinal end 31 of the mouthpiece 30, and a channel 36 fluidly connecting the inlet 34 with the outlet 35. The second longitudinal end 32 of the mouthpiece 30 comprises a connector (not shown) that is releasably engageable with a connector (not shown) of the first longitudinal end 11 of the body 10, so as to connect the mouthpiece 30 to the body 10.

In other embodiments, the mouthpiece 30 and the body 10 may be permanently connected, such as through a hinge or flexible member. When the apparatus 2 is in use, the first longitudinal end 31 of the mouthpiece 30 forms a first longitudinal end of the apparatus 2, and the second longitudinal end 12 of the body 10 forms a second longitudinal end of the apparatus 2.

In order to address various issues and advance the art, the entirety of this disclosure shows by way of illustration and example various embodiments in which the claimed invention may be practiced and which provide for a superior cartridge and/or pouch for use with apparatus for heating smokable material to volatilize at least one component of the smokable material. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. A pouch for use with apparatus for heating smokable material to volatilize at least one component of the smokable material, the pouch comprising:

a first wall made of a first material that is porous; and a second wall made of a second material that is a different material to the first material, wherein the second wall is porous for permitting aerosol or volatilized material generated within the pouch to pass out of the pouch from within the pouch, and the first wall is less porous to the aerosol or volatilized material than the second wall, and wherein the pouch contains smokable material between the first wall and the second wall.

2. A pouch according to claim 1, wherein the smokable material comprises an aerosol forming agent.

3. A pouch according to claim 1, wherein pouch further comprises a mass of aerosol containment material, which is free from smokable material.

4. A pouch according to claim 3, wherein the smokable material is in contact with the mass of aerosol containment material.

5. A pouch according to claim 3, wherein the second wall comprises the mass of aerosol containment material.

6. A pouch according to claim 3, wherein the pouch contains the mass of aerosol containment material.

7. A pouch according to claim 6, wherein the mass of aerosol containment material is located between the smokable material and the second wall of the pouch.

8. A pouch according to claim 3, wherein the aerosol containment material comprises one or more materials selected from the group consisting of wadding, fleece, non-woven material, non-woven fleece, woven material, knitted material, nylon, foam, polystyrene, polyester, polyester filament, polypropylene, and a blend of polyester and polypropylene.

9. A pouch according to claim 3, wherein the aerosol containment material comprises wadding or fleece, such as with a density between about 60 gsm and about 140 gsm.

10. A cartridge for use with apparatus for heating smokable material to volatilize at least one component of the smokable material, the cartridge comprising:

a housing defining a chamber; and the pouch according to claim 1, wherein:

the pouch is located within the chamber, at least part of the pouch is made of porous material for permitting aerosol or volatilized material generated within the pouch to pass out of the pouch from within the pouch, the pouch defines part of an exterior surface of the cartridge, the exterior surface of the cartridge comprises a cavity for receiving in use a heating device for heating the smokable material, and the pouch defines at least part of the cavity.

11. A cartridge according to claim 10, wherein the pouch is a first pouch that defines a first part of the cavity, wherein the cartridge comprises a second pouch that contains smokable material and defines a second part of the cavity, and wherein at least part of the second pouch is made of porous material for permitting aerosol or volatilized material generated within the second pouch to pass out of the second pouch from within the second pouch.

12. A cartridge according to claim 11, wherein the first pouch and the second pouch define opposite sides of the cavity.

13. A cartridge according to claim 10, wherein the pouch comprises a first wall made of a first material and a second wall made of a second material that is a different material to the first material, and wherein the smokable material is arranged between the first wall and the second wall.

14. A cartridge according to claim 13, wherein the second wall is porous for permitting aerosol or volatilized material generated within the pouch to pass out of the pouch from within the pouch, and the first wall is less porous to the aerosol or volatilized material than the second wall.

15. A cartridge according to claim 10, wherein the pouch is attached to the housing.

16. A cartridge according to claim 10, comprising a mass of aerosol containment material within the chamber.

17. A cartridge according to claim 16, wherein the aerosol containment material comprises one or more materials selected from the group consisting of: wadding, fleece, non-woven material, non-woven fleece, woven material, knitted material, nylon, foam, polystyrene, polyester, polyester filament, polypropylene, and a blend of polyester and polypropylene.

18. A cartridge according to claim 10, wherein at least part of the pouch comprises one or more materials selected from the group consisting of: fleece, viscose, non-woven material, non-woven fleece, woven material, knitted material, nylon, and polyester.

19. A method of manufacturing a pouch for use with apparatus for heating smokable material to volatilize at least one component of the smokable material, the method comprising:

providing a first wall made of a first material and a second wall made of a second material that is a different material to the first material, wherein the first and second walls are porous for permitting aerosol or volatilized material generated within the pouch to pass out of the pouch form within the pouch, and the first wall is less porous to the aerosol or volatilized material than the second wall; and attaching the first wall to the second wall with the smokable material between the first wall and the second wall.

20. A method according to claim 19, comprising depositing the smokable material onto the second wall, and then attaching the first wall to the second wall with the smokable material between the first wall and the second wall.

21. A method according to claim 20, wherein the second wall defines a pocket, and wherein the depositing comprises depositing the smokable material into the pocket.

22. A method according to claim 21, wherein the depositing comprises depositing the smokable material and aerosol containment material into the pocket.

23. A method according to claim 19, wherein the second wall is porous for permitting aerosol or volatilized material generated within the pouch to pass out of the pouch from within the pouch, and the first wall is less porous to the aerosol or volatilized material than the second wall.

24. A method according to claim 19, wherein the smokable material comprises tobacco.

* * * * *